United States Patent [19]

Miyamori et al.

[11] Patent Number: 4,762,652

[45] Date of Patent: Aug. 9, 1988

[54] PROCESS AND APPARATUS FOR PRODUCING CARBON FIBER MAT

[75] Inventors: Tamotsu Miyamori; Iwao Kameyama; Takeo Abe, all of Iwaki, Japan

[73] Assignee: Kureha Kagaku Kogyo Kabushiki Kaisha, Japan

[21] Appl. No.: 875,704

[22] Filed: Jun. 18, 1986

[30] Foreign Application Priority Data

Jun. 28, 1985 [JP] Japan ..... 60-142055

[51] Int. Cl.[4] ..... D01F 9/14

[52] U.S. Cl. ..... 264/6; 264/8; 264/29.2; 264/29.6; 264/518; 423/447.4; 423/447.7; 425/8; 425/83.1; 425/289

[58] Field of Search ..... 264/8, 29.2, 29.6, 29.7, 264/148, 143, 211.1, 6, 518, 210.3, 210.2, 108; 425/8, 72 R, 725, 308, 289, 82.1, 83.1; 423/447.1, 447.2, 447.4, 447.7, 447.8

[56] References Cited

U.S. PATENT DOCUMENTS

| | | | |
|---|---|---|---|
| 3,424,832 | 1/1969 | Chisholm | 264/148 |
| 3,776,669 | 12/1973 | Ito et al. | 425/8 |
| 3,819,345 | 6/1974 | Battigelli | 65/6 |
| 3,976,729 | 8/1976 | Lewis et al. | 264/29.7 |
| 4,265,869 | 5/1981 | Kaji et al. | 264/29.2 |
| 4,276,278 | 6/1981 | Barr et al. | 423/447.4 |
| 4,314,981 | 2/1982 | Miyamori et al. | 423/447.7 |
| 4,348,341 | 9/1982 | Furuya et al. | 264/8 |
| 4,606,872 | 8/1986 | Watanabe | 264/29.2 |
| 4,610,860 | 9/1986 | Mullen | 423/447.8 |

FOREIGN PATENT DOCUMENTS

| | | | |
|---|---|---|---|
| 59-150106 | 8/1984 | Japan | 264/148 |

*Primary Examiner*—James Lowe
*Assistant Examiner*—Mary Lynn Fertig
*Attorney, Agent, or Firm*—Nixon & Vanderhye

[57] ABSTRACT

Disclosed herein are a process for producing a carbon fiber mat, having excellent production and energy efficiencies, comprising successively melt-spinning a fiber-forming pitch by a centrifugal spinning machine having a horizontal axis of rotation (parallel to the plane on which the spinning machine is placed), forming a mat by the thus spun pitch fibers, bringing the mat into an infusibilized state in an air atmosphere containing $NO_2$ and calcining the thus infusibilized mat in an inert atmosphere, and an apparatus for carrying out the above-mentioned process.

17 Claims, 4 Drawing Sheets

PROCESS AND APPARATUS FOR PRODUCING CARBON FIBER MAT

BACKGROUND OF THE INVENTION

The present invention relates to a process for producing a carbon fiber mat and an apparatus for carrying out the process, and more specifically relates to a process having excellent production and energy efficiencies, comprising successively melt-spinning a fiber-forming pitch by a centrifugal spinning machine having a horizontal axis of rotation (parallel to the plane on which the spinning machine is placed), forming a mat by the thus spun pitch fibers, bringing the mat into an infusibilized state in an air atmosphere containing $NO_2$ and calcining the thus infusibilized mat in an inert atmosphere, and an apparatus for carrying out the above-mentioned process.

Hitherto, as a method for melt-spinning a pitch in the production of carbon fibers of pitch series, fixed spinning and centrifugal spinning methods are known, and by such methods, spinning can ordinarily be carried out at a velocity of greater than a few hundred meters per minute, particularly at a velocity of as high as 2000 m/min in the case of the centrifugal spinning method.

However, since in the after-treatment steps including infusibilization, particularly in the step of infusibilization, the reaction velocity is slow and the thus spun pitch fiber is extremely fragile and easily snapped by even a slight impact, the following various methods have been used:

(1) after towing the spun fibers, the towed fibers are hung on a bar on the upper side of a U-shaped tray and treated at every tray, (2) the spun fibers are piled-up on a mesh belt, or (3) the spun fibers are once wound on a bobbin, and thereafter, unwound, thereby continuously treated as filaments.

However, in the towing method, particularly in the case of collecting in spun fibers as a tow by using a centrifugal spinning machine having the rotating axis perpendicular to the horizontal plane on which the machine is placed (refer to U.S. Pat. No. 3,776,669, for instance), it is difficult to control the formation of the two. In addition, since in the steps of infusibilization and calcination, the ratio of the volume of the product to the volume of the apparatus must be too small, the efficiency of production is low and the energy consumption is large. The towing method has other demerits that the long term operation of the apparatus is hindered by dirts due to tar and dust and it is difficult to close-up the apparatus.

In the mesh belt method, the production efficiency is low, because the fibers are only piled up, and in the case of increasing the weight/area of the piled fibers by forced ventilation, local damage to the fibers is apt to be caused. In addition, the disadvantages of frequent mechanical troubles relating to the high-speeded traverse and of the difficulty in obtaining stabilized quality have been pointed out.

Besides, in the continuous treatment of the filaments, since it takes a long time to handle the filaments so as to prevent snapping of the filaments, production efficiency is also poor and accordingly, actual practice of such a method is difficult.

As has been stated, every one of the hitherto-proposed methods has a poor production efficiency, and as a result, it is inevitable that the carbon fibers are obtained at the expense of high production costs.

As a result of the present inventors' studies for improving the disadvantages of the conventional processes for producing carbon fibers, it has been found that in the case of forming a pitch fiber mat by melt-spinning a pitch in a centrifugal spinning machine having an axis of rotation provided to be horizontal and piling the thus spun pitch fibers on a belt of a horizontal belt-conveyer which traverses in a parallel direction to the above-mentioned axis of rotation and also moves in the orthogonal direction thereto, a pitch fiber mat in which the fibers have been oriented and which has a sufficient strength is available and the steps of forming the carbon fiber mat including spinning, infusibilizing and calcining are continuously carried out whereby the efficiencies or production and energy are remarkably improved. The present invention has been attained based on the above-mentioned findings.

Accordingly, the objective of the present invention is to provide a process for preparing the carbon fibers derived from pitch, which does not have the disadvantages as in the conventional processes for producing carbon fibers and is high in production and energy efficiencies, namely an economical process which is high in furnace efficiency ($kg/m^3 \cdot hour$) represented by the weight (kg) of treated fibers per hour per volume ($m^3$) of the furnace and low in energy consumption per unit amount of production and which gives a carbon fiber mat directly used as the heat-insulating material or easily processable into chops, milled articles and the like.

SUMMARY OF THE INVENTION

In a first aspect of the present invention, there is provided a process for producing a carbon fiber mat, comprising successively melt-spinning a fiber-forming pitch by centrifugal spinning machine having a horizontal axis of rotation, stretching the thus melt-spun pitch fibers, cutting the thus stretched fibers by at least one cutter installed on the stretching plate of said centrifugal spinning machine, piling the thus cut fibers on the belt of a horizontal belt conveyer which has been installed under said spinning machine, traverses in the direction parallel to said rotation axis and moves in the direction orthogonal to said axis of rotation, thereby forming a pitch fiber mat, and subjecting the thus piled pitch fiber mat to infusibilization in an air atmosphere containing $NO_2$ and calcination in an inert atmosphere to obtain said carbon fiber mat.

In a second aspect of the present invention, there is provided an apparatus for continuously producing a carbon fiber mat, comprising (1) an apparatus for producing pitch fiber mat, comprising (i) a centrifugal spinning machine which has at least one cutter for cutting said pitch fibers on the stretching plate thereof and has been installed so that the axis of rotation of said centrifugal spinning machine is horizontal and (ii) a horizontal belt conveyer having a belt which traverses in the direction parallel to said axis of rotation of said centrifugal spinning machine and moves in the direction orthogonal to said direction of said axis of rotation, (2) a conveyer for transferring said pitch fiber mat, (3) an infusibilizing furnace, (4) a conveyor for transferring the infusibilized mat and (5) a vertical type calcining furnace.

In a third aspect of the present invention, there is provided a carbon fiber mat produced by said process.

BRIEF EXPLANATION OF DRAWINGS

Of the attached drawings.

DETAILED DESCRIPTION OF THE INVENTION

The process for producing a carbon fiber mat according to the present invention comprises the steps of (1) successively melt-spinning a pitch of fiber-forming property by a centrifugal spinning machine having a horizontal axis of rotation, and thereafter stretching the thus melt-spun pitch fibers by the centrifugal force and a fluid stream, (2) cutting the thus stretched pitch fibers by at least one cutter installed on the stretching plate of the spinning machine, (3) piling the thus cut pitch fibers on a belt of a horizontal belt conveyor which has been installed under the spinning machine, which belt traverses (reciprocally) in the direction parallel to the axis of rotation of the spinning machine and moves in the direction orthogonal thereto, thereby forming a pitch fiber mat, (4) subjecting the thus formed, pitch fiber mat to infusibilization and calcination to obtain a carbon fiber mat.

The process for producing the carbon fiber mat according to the present invention is explained more in detail while referring to the attached drawings.

Figure 1:
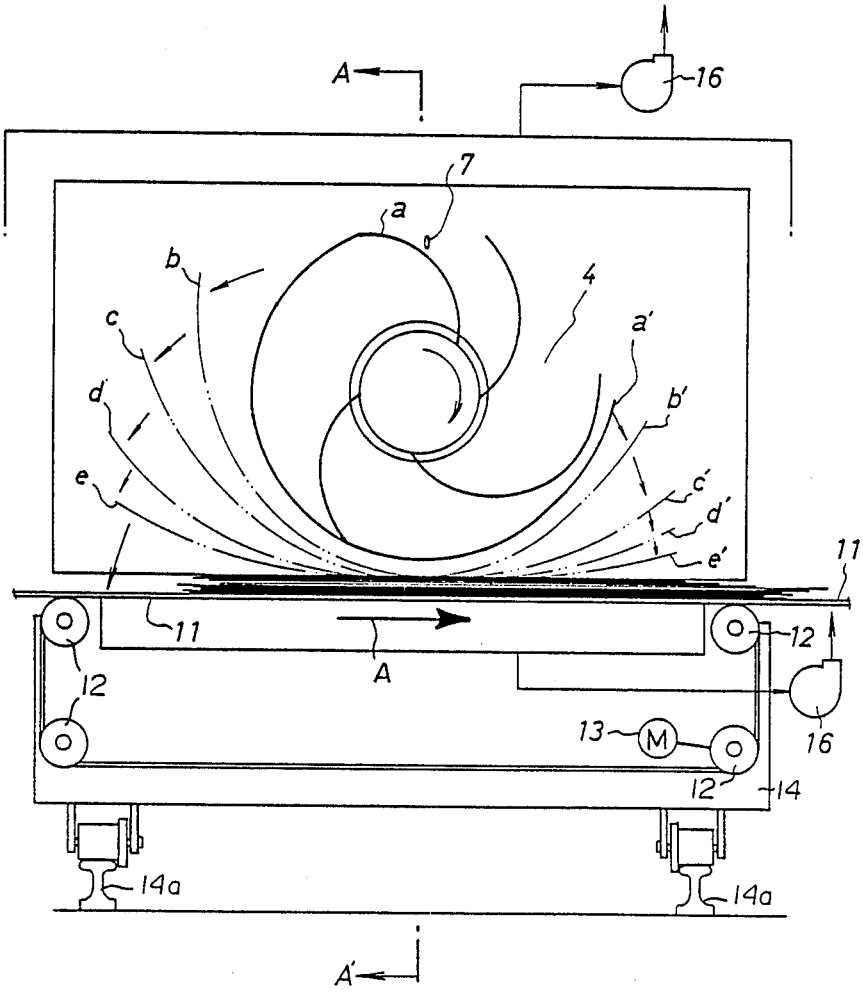
FIG. 1 is the centrifugal spinning machine and the belt conveyer seen from the direction of the spinning machine's axis of rotation, FIG. 2(*a*) is the cross-section along the line A—A' of the centrifugal spinning machine and the belt conveyer in FIG. 1, FIG. 2(*b*) is an enlarged view of the rotating bowl and stretching plate shown in FIG. 2(*a*)
Figure 2:
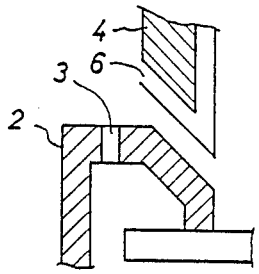
Figure 2:
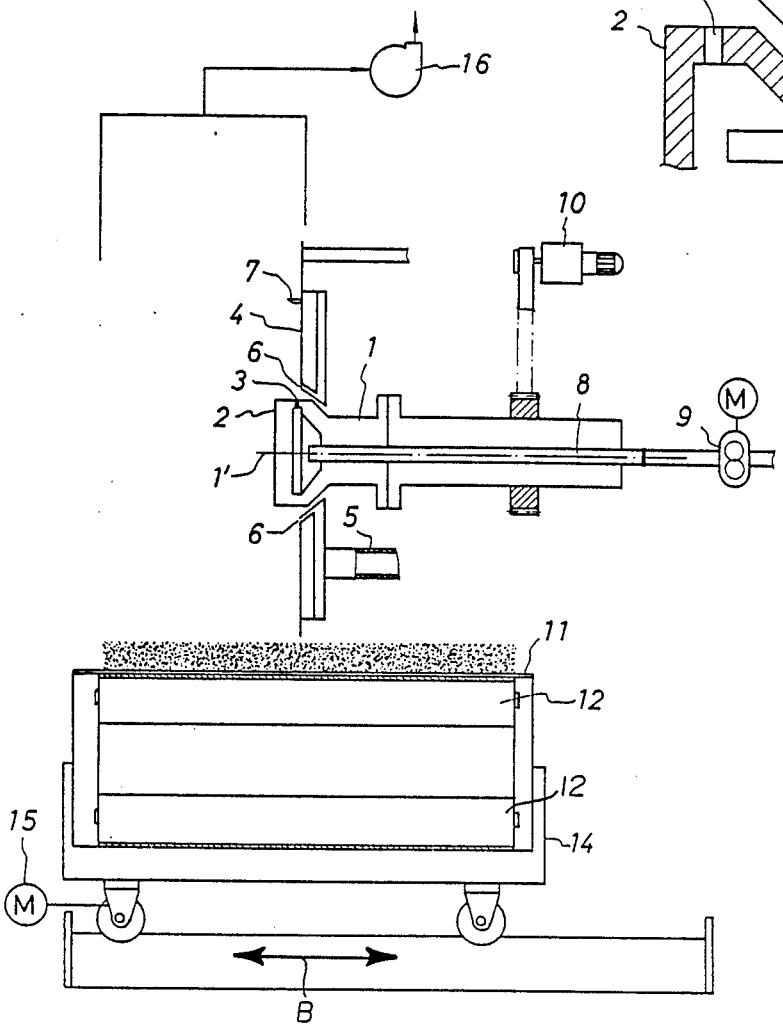
Figure 3:
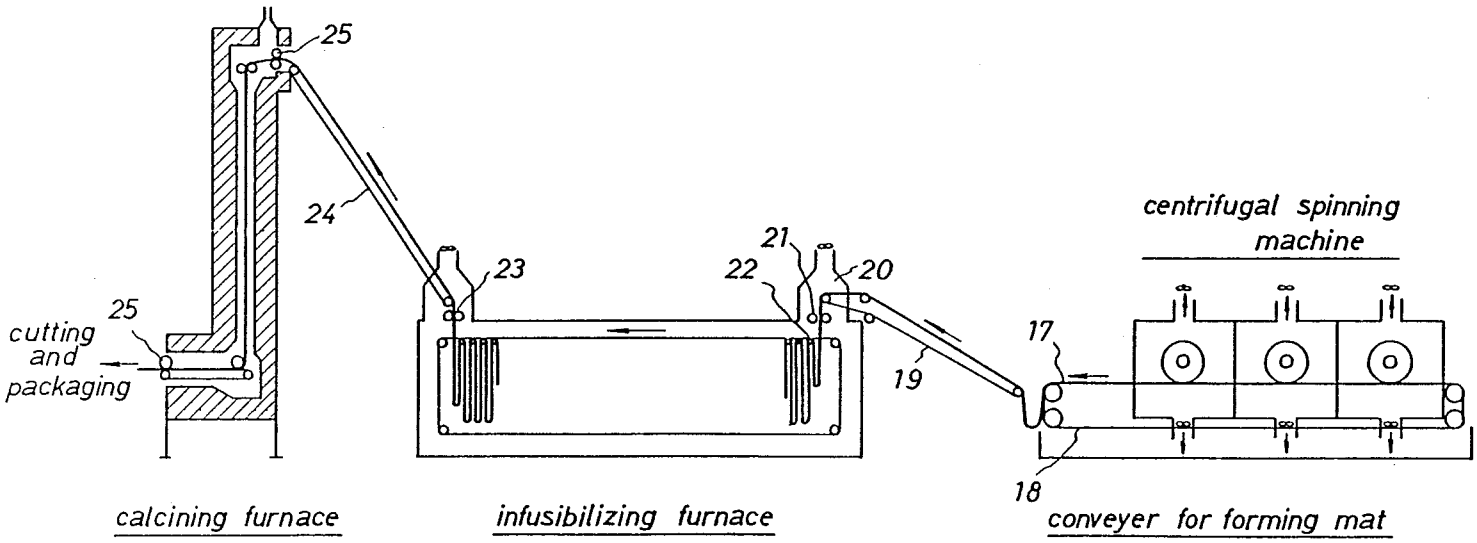
FIG. 3 is a flow chart of the process according to the present invention and FIG. 4 is a flow chart of a conventional process.

FIG. 1 shows a side view of the centrifugal spinning machine and the belt conveyer installed under the spinning machine as seen from the direction of the spinning machine's axis of rotation. FIG. 2(*a*) is a cross-section along the line A—A' shown in FIG. 1 of the same spinning machine/belt conveyer, FIG. 2(*b*) is an enlarged view of the rotating bowl and stretching plate shown in FIG. 2(*a*), and FIG. 3 is a flow chart of the process according to the present invention.

As are seen in FIGS. 1, 2(*a*), and 2(*b*), the heated and molten pitch is supplied quantitatively by a gear pump 9 via a pitch-supplying line 8 within a spinning cylinder 1 acting as an axis of rotation 1', and is poured into a rotating bowl 2 having many nozzles 3 arranged on the periphery thereof in a single, double or multiple lines. The thus poured molten pitch is extruded through the nozzles 3 in the form of spun fibers by the centrifugal force generated by the rotation of the rotating bowl 2.

The thus spun fibers are stretched along the external surface of the stretching plate 4 surrounding the spinning cylinder 1 due to the generated force and due to a stretching fluid stream which is supplied via a pipe 5 and is directed from outlet 6 (surrounding the spinning cylinder 1); uniformly to the vicinity of the nozzles 3 in the fiber spinning direction.

The thus stretched pitch fibers are cut by bringing the fibers into contact with at least one cutter 7 on the stretching plate 4 for each revolution of the rotating bowl 2. Thus, cut fibers of a substantially constant length are produced in a number corresponding to the number of the nozzles 3 for each revolution of the rotating bowl 2.

The thus cut, pitch fibers are piled on a conveyer belt 11 while twining to each other in monofilament state and displaying a locus shown in FIG. 1 by a–e and a'–e' by e.g., the stretching fluid stream, gravity and an optional suction from the opposite side to the side of the piled fibers of the conveyer belt 11.

The conveyor belt 11 is mounted upon a carriage 14 for movement in the direction of arrow A (FIG. 1) by means of rollers 12 driven by motor 13. The carriage 14 is, in turn, rollably supported on tracks 14*a* so that the carriage 14 (and hence belt 11) is reciprocally movable by means of motor 15 parallel to the rotation axis 1' of cylinder 1 (i.e. in the direction of arrow B in FIG. 2(*a*)). Thus, conveyer belt 11 not only moves the piled surface of the cut pitch fibers in the stretching direction (arrow A in FIG. 1) but also simultaneously traverses (reciprocally) in a direction perpendicular to the stretching direction (arrow B in FIG. 2) preferably at a speed at least twice the speed at which the belt 11 moves in the direction of arrow A. As a result, a continuous mat of the pitch fibers having a constant width, a constant thickness and a sufficient strength to be treated as the continuous mat in the after-treatment steps is formed.

As are seen in FIG. 3, the thus formed, continuous mat 17 is transferred directly from a conveyer belt 18 for forming the mat of the entrance 20 of an infusibilizing furnace via a conveyer belt 19 for transferring the mat. The mat is then hung on a bar 22 via a simple curtain or a double rollers 21 for isolating the internal space of the furnace from the surrounding atmosphere.

The bar 22 circulates at a uniform speed determined by the speed of the conveyer, the interval of the bars and the hanging length of the mat, so that the pitch fiber mat is treated continuously. The mat is hung smoothly by controlling the interval of the bars corresponding to the aerial weight and the thickness of the mat.

In the infusibilizing furnace, air containing from 0.1 to 10% by volume of $NO_2$ is kept at a temperature of from 100° to 400+ C., and by retaining the pitch fiber mat therein for from 1 to 4 hours, the pitch fibers of the mat are subjected to infusibilization.

The infusibilizing furnace is constituted so that the temperature of the gas therein is raised slowly from the inlet to the outlet of the furnace, and for that purpose, a number of blowers or fans are installed at an appropriate interval to introduce the gas in the direction perpendicular to the direction of the orientation of the pitch fibers of the mat and circulate the gas.

The thus infusibilized mat is transferred to the calcining furnace with a conveyer 24 via the air curtain or the double rollers 23 for sealing the surrounding atmosphere. At the inlet and outlet of the calcining furnace, the same curtain of gaseous nitrogen or the double rollers 25 as those of the infusibilizing furnace is provided.

The atmosphere within the calcining furnace is gaseous nitrogen kept at a temperature of from 300° to 900° C., and by retaining the infusibilized mat for from 5 to 30 min in the calcining furnace, the mat is subjected to calcination. Since the mat introduced into the calcining furnace has a sufficient strength, the mat is treated while hanging by its own weight without a bar.

From the thus carbonized fiber mat, chops, milled articles and belts thereof are easily prepared, or the thus carbonized fiber mat may be used per se as a heat-insulating material.

The pitch for use according to the present invention may be from 89 to 97% by weight in carbon content and from 400 to 5000 in average molecular weight. The mesophase pitch of a high softening point can be used by heating thereof to a temperature at which the pitch can be subjected to centrifugal spinning.

Although there are various types of the centrifugal melt-spinning machine such as rotating cylinder type and rotating nozzle type, every one of them can be used according to the present invention. In addition, although the figures of the attached drawings exemplify the use of a rotating nozzle type centrifugal centrifugal spinning machine, the present invention is not at all restricted thereby.

The diameter of the rotating bowl of the centrifugal spinning machine is preferably from 100 to 500 mm, and in the case of below 100 mm, the production efficiency becomes a problem, and on the other hand, in the case of over 500 mm, a mechanical problem is apt to be caused by the unevenness of the temperature.

The velocity of the stretching fluid stream is preferably from 80 to 120 m/sec, and the rotation number of the rotating bowl depends on the shape of the nozzles and the amount of the pitch treated therein, however, it is adjusted not to cause an accidental cutting of the pitch even in the case of fluctuation of the spinning temperature.

The diameter of the nozzle hole is preferably not less than 0.6 mm for avoiding nozzle clogging and facilitating nozzle cleaning. However, in order to avoid accidental cutting of the pitch, the diameter is preferably in the range of 0.6 to 1.0 mm.

The aerial weight and the thickness of the thus prepared, carbon fiber mat can be optionally adjusted corresponding to the capacity and number of the spinning machine and the speed and width of the conveyer belt, however, they are restricted by the production efficiency of the after-treatment step comprising the operation of cooling and heating. In the case where the aerial weight and thickness of the mat is small, the production efficiency is low, however, in the case where they are too large, it is difficult to control the reaction in the infusibilizing step and it takes much time for raising the temperatures of the mat in the calcining step. Concretely, the aerial weight and thickness are preferably from 0.2 to 5 kg/m$^2$ and from 10 to 100 mm, respectively.

From the view points of the apparatus and the operation, the following conditions of the apparatus are desirable:

(1) the number of the nozzle holes of the rotating bowl is from 200 to 2000, (2) the revolution number of the rotating bowl is from 300 to 1000 rpm, (3) the traverse (reciprocation) speed of the conveyer belt is from 1 to 50 m/min and (4) the moving speed of the mat is from 0.1 to 6 m/min.

Although the width of the mat is decided and optionally selected by the width of traverse, it is preferably not more than 3 m from the view point of handling in the after-treatment steps.

Although the conveyer belt of an optional width may be used, it is desirable that a ventilable belt is used for carrying the piled pitch fibers smoothly. Suction is preferably carried out on that side of the belt opposite to the side on which the fibers are piled.

One of the important characteristics of the present invention lies in the use of a centrifugal spinning machine having a horizontal axis of rotation and a vertical rotating surface (perpendicular to the plane on which the spinning machine is placed), and in the afore-mentioned steps for continuously producing a pitch fiber mat of oriented fibers, which has the desired thickness, aerial weight and width as well as the sufficient mat strength.

By the above-mentioned characteristic, the following effects of the present invention have been obtained.

Figure 4:
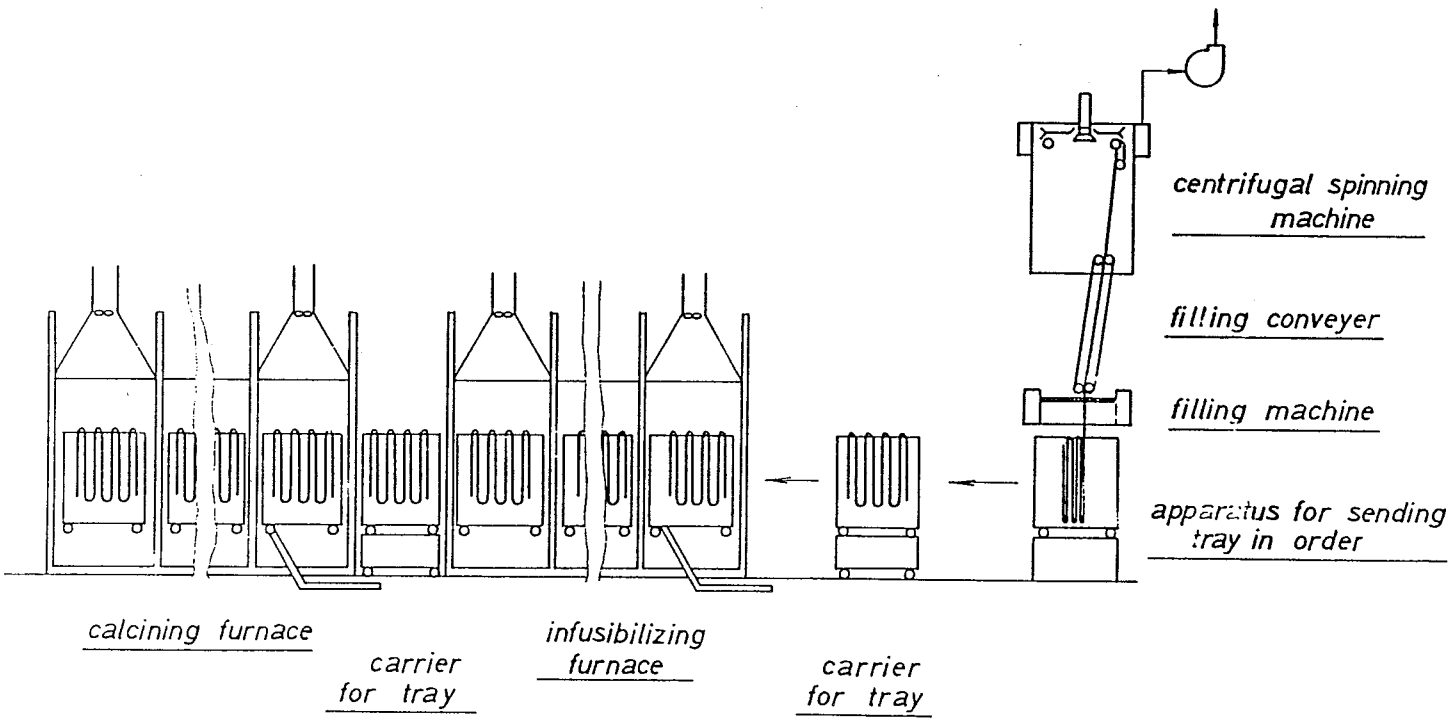
Fig. 4 PRIOR ART

(i) It is not necessary to use the bar-type hanging apparatus for tows, which has been necessary in the case where the pitch fibers are taken out from a conventional spinning machine in the shape of tow, that is, the bar-type hanging apparatus being the filling machine (refer to FIG. 4) which moves the tow in the orthogonal direction to the hanging bar and traverses the tow in the horizontal direction to the hanging bar.

(ii) In infusibilization, the removal of the reaction heat is effectively carried out due to the favorable orientation of the mat fibers, and accordingly, the treatment density can be raised resulting in the improvement of the production efficiency of the furnace.

(iii) Infusibilization can be continuously carried out, because a mat of a far larger size as compared to the conventional tows can be treated due to the improvement of thermal treatment owing to the above-mentioned orientation of the fibers. As a result thereof, the use of conventional trays are not necessary thereby avoiding the concomitant heating energy for the tray. In addition, the furnace can be minimized resulting in a reduction of heat loss, the efficiencies of energy and apparatus thereby being remarkably improved.

(iv) Since it is able to treat the mat in the calcining furnace while hanging the mat by its own weight without a bar, the treating density becomes larger as compared to the conventional method which uses bar-hanging and U-type trays. In addition, it is able to reduce broadly the time for uniformly heating the outside and inside of the mat, and accordingly the production efficiency is remarkably improved.

In addition, the calcining furnace itself can be minimized, the heating energy for the trays becomes unnecessary since the trays are not used and the heat loss from the surface of the furnace is greatly reduced resulting in increased economy of heat energy.

(v) Although the entrance of gaseous hydrogen and carbon dioxide generated in the low temperature region in the calcining furnace into the high temperature region thereof leads usually to the deterioration of the fiber properties, since the space between the inner wall of the calcining furnace and the mat can be maintained less than a few cm, such an entrance can be avoided by the use of a small amount of a carrier gas.

(vi) The uniformity in infusibilization can be easily maintained, because the thickness and aerial weight of the mat can be easily adjusted as has been stated.

(vii) Since the continuous mat can be treated, the seals in the infusibilizing furnace and the calcining furnace can be carried out by a double roller or a nipple roller, and accordingly, a large room for substituting the atmosphere is not necessary.

In addition, even only in consideration of the spinning step, the following effects can be pointed out:

(i) The stability in spinning is improved, and the closing up of the spinning step is easily carried out.

(ii) Since the whole apparatus become simplified, the operational troubles are reduced.

(iii) Since it is not necessary to maintain the comb in spinning, the occurrence of the generation of dusts is small, and since it is able to recover the dusts and to add the recovered dusts to the mat, the amount of fibers loss in spinning is remarkably reduced.

The present invention will be explained more in detail while referring to Examples and Comparative Examples.

EXAMPLE 1

A so-called ethylene bottom oil, a residual high-boiling fraction obtained by thermally cracking petroleum naphtha and fractionally recovering olefins such as ethylene, propylene, etc., was subjected to thermal treatment at 380° C. and then to distillation at 320° C. under a pressure of 10 mmHg abs. to obtain a residual pitch of the carbon content of 94.5% by weight, the average molecular weight of 620 and the softening point (by KOKA-type flow tester) of 170° C.

The thus obtained pitch was subjected to melt-spinning while using three centrifugal spinning machines of horizontal type of 350 in a nozzle holes number and 200 mm in a bowl diameter, which were arranged in parallel to the conveyer, at a treating amount of pitch of 13.2 kg/hour/machine, a number of revolution of 800 rpm and at a velocity of stretching wind of 100 m/sec.

The thus melt-spun fibers were subjected successively to cutting by the cutter, and then piled on a belt conveyer having a metal mesh belt of 40 mesh traversing 5 times/min and moving (sending) at a speed of 0.44 m/min. The mat had an effective width of 2 m, the aerial weight of 0.75 kg/m$^2$, the thickness of 50 mm and the apparent density of 15 kg/m$^3$ and could be treated as the continuous fiber, although the mat is an aggregate of short fibers.

The thus prepared mat was subjected to infusibilization in an infusibilizing furnace of 10 m in total length while hanging the mat in length of 1.5 m on the bars of 2 m in width which are circulated within the furnace at a constant velocity of 0.044 m/min and are arranged at the intervals of 300 mm, and circulating an air containing 2% of $NO_2$ in the direction perpendicular to the direction of orientation of the mat in the furnace at a velocity (as a superficial velocity in a column) of 0.5 m/sec for removing the reaction heat of infusibilization. In the above-mentioned operation, the mat is infusibilized by heating to a temperature of from 100° to 250° C. within 3 hours. The necessary energy (the sum of calory for heating and an electric power for blower) for infusibilization was 136 kwh as an electric power.

Thereafter, the mat was introduced into a calcining furnace of vertical type of 14.8 m in total length including a cooling part and 2 m in width while hanging the mat by its own weight without a bar and was calcined therein by heating up to 850° C. during 15 min and after cooling the thus calcined mat to 200° C., the cooled mat was sent out from the furnace. The amount (calculated in the condition of normal temperature of 0° C. and pressure of 1 atm.) of the carrier gaseous nitrogen was 90 Nm$^3$/hour. The necessary energy (calory for heating) for calcining was 64 kwh and the furnace efficiency was 13.4 kg/m$^3$·hour.

By cutting the thus obtained mat by a cutter into 10 mm in length, the very uniform short fibers were obtained. The fiber length was distributed in the range of from 6 to 20 mm with the standard deviation of the fiber length of 1 mm. The milled articles and the heat-insulator prepared from the thus obtained short fibers showed the same quality as compared to that of the standard ones.

The thus obtained carbon fibers were excellent showing no adhesion between the fibers, and having the diameter of 18 micrometers, the strength of 70 kg/mm$^2$ and the elastic modulus of 3180 kg/mm$^2$ (an elogation of 2.2%) in the unit fiber.

EXAMPLE 2

The pitch used in Example 1 was subjected to melt-spinning while using two horizontal centrifugal spinning machines of 584 nozzle holes and 330 mm in the diameter of the bowl rotating at 600 rpm and treating the pitch of 21.6 kg/hour under the velocity of stretching wind of 100 m/sec.

By subjecting the thus spun pitch fibers to mat-forming on a conveyer belt of 2 m in width with traversing 6 times/min and sending at a speed of 0.88 m/min, a mat of 0.4 kg/m$^2$ in aerial weight, 45 mm in thickness and 9.1 kg/m$^3$ in apparent density was obtained. By treating the thus obtained mat of the pitch fibers in the same infusibilizing furnace and then in the same calcining furnace as those in Example 1, the mat of carbon fibers showing the same fiber properties as those in Example 1 were obtained.

EXAMPLE 3

The same pitch as in Example 1 was subjected to melt-spinning while using three horizontal centrifugal spinning machines of 500 nozzle holes and 200 mm in the diameter of the bowl rotating at 900 rpm and treating the pitch of 10.8 kg/hour/machine under the velocity of stretching wind of 105 m/sec to obtain the pitch fiber, and the thus obtained pitch fibers were piled on a conveyer belt of 2 m in width and 0.75 m/min of the sending speed, which traversed 6 times per min to obtain a mat of 0.36 kg/m$^2$ in aerial weight, 60 mm in thickness and 6 kg/m$^3$ in apparent density.

By subjecting the thus obtained pitch fiber mat to the treatment in the same infusibilizing furnace and calcining furnace as in Example 1, the favorable carbon fibers of 12.7 micrometers in fiber diameter, 80 kg/mm$^2$ in strength and 3640 kg/mm$^2$ in elastic modulus (2.2% in elongation) were obtained without any problem.

COMPARATIVE EXAMPLE

By using the same pitch as in Example 1, tows of the pitch fibers were prepared in a conventional spinning machine of vertical type (the rotation axis was vertical), and the tows were subjected to infusibilization and calcination while placing the tows in a U-type tray.

In the present case, as compared to the present invention, the following items were necessary:

(i) The spinning machines provided with rotatory comb. (The number of the machines is the same as in the present invention.)

(ii) A mechanism for hanging the tows on the tray and transferring the tray and (iii) A room having sufficient space for admitting the trays at the entrance and exit of the furnaces.

In the infusibilization of the thus spun fibers, by using the same conditions as in Example 1, namely, the content of $NO_2$ of 2%, the retention time of 3 hours (length of the furnace being 27 m) and the velocity of the circulating gas of 0.5 m/sec, respectively, the cycle time of tray of 16 min and a filling amount of 10.6 kg/tray were the best mode of reaction control while using a tray of 1.6 m in width, 0.9 m in length and 1.6 m in height.

The efficiency of the furnace was 1.01 kg/m$^3$·hour with the amount of consumption of energy of 189 kwh.

According to the above mode, the retention time of 2 hours was necessary for calcination step including cooling step in the furnace of 17.6 m in length.

The efficiency of the calcining furnace was 1.56 kg/m$^3$·hour with the amount of energy consumption of 285 kwh while using the carrier gas (nitrogen) of 200 Nm$^3$/hour.

The datas in Example 1 and Comparative Example are shown in detail as follows:

-continued

| Spinning | Conventional (centrifugal spinning - tow) | Present Invention (centrifugal spinning - mat) |
|---|---|---|
| Tray | 35 units necessary (cycle time of tray of 16 min) | not necessary |
| Speed of mat | | 0.44 m/min*[4] |

Notes:
[1]Since the retaining time in comb of conventional spinning was none, the generation of the dusts was small, and since the dusts were able to be recovered and added to the mat, the loss was remarkably reduced.
[2]It could be attained to from 0.2 to 5 kg/m$^2$ and preferably, from 0.4 to 2 kg/m$^2$.
[3]It could be attained to from 10 to 100 mm and preferably, from 20 to 60 mm.
[4]In the case of over 0.44 m/min, there is a necessity of increasing the height of the calcining furnace and there is a fear of breaking the mat by its own weight.

| Infusibilization | Conventional (centrifugal spinning-tow) | Present invention (certrifugal spinning-mat) |
|---|---|---|
| Interval of bars | 120 mm | 300 mm |
| Length of furnace | 27.2 m | 10 m |
| Height of furnace | 1.6 m | 1.5 m |
| Width of furnace | 0.9 m | 2 m |
| Speed of gas in circulation | to 0.5 m/sec | to 0.5 m/sec |
| Retention time | 3 hours | 3 hours |
| Efficiency of furnace | 39.6(kg/hr)/(27.2 × 1.6 × 0.9)(m$^3$) = 1.01 kg/m$^3$ · hour | 39.6(kg/hr)/(10 × 1.5 × 2)(m$^3$) = 1.32 kg/m$^3$ · hour*[5] |
| Consumption of electric power | 189 kwh | 136 kwh*[6] |

Notes:
[5]The reaction heat was sufficiently diffused due to the better orientation of the fibers in the mat than in the conventional tow, and the efficiency of furnace was improved.
[6]The difference between the consumptions of electric power, namely 53 kwh = 189-136, consists of 32 kwh of heat loss and 21 kwh of the calory for heating the tray.

| Calcination | Conventional (centrifugal spinning-tow) | Present invention (centrifugal spinning-mat) |
|---|---|---|
| Length of furnace | 17.6 m | 14.8 m |
| Height of furnace | 1.6 m | 0.1 m |
| Width of furnace | 0.9 m | 2 m |
| Retention time | 2 hours | 20 minutes |
| Amount of carrier nitrogen gas | 200 Nm$^3$/hour | 90 Nm$^3$/hour*[7] |
| Efficiency of furnace | 39.6(kg/hr)/(17.6 × 1.6 × 0.9)(m$^3$) = 1.56 kg/m$^3$ · hour | 39.6(kg/hr)/(14.8 × 0.1 × 2)(m$^3$) = 13.4 kg/m$^3$ · hour*[8] |
| Consumption of electric power | 285 kwh | 64 kwh*[9] |
| Cooling water | 5.5 m$^3$/hour | 1.3 m$^3$/hour |

Notes:
[7]Due to the large density of treatment, the inverse mixing was small with the piston flow. Accordingly, the amount per product was also small.
[8]Since only the mat is treated, it was possible to minimize the size of the furnace to remarkably improve the efficiency of furnace.
[9]The difference between 285 and 64 kwh, i.e., 221 kwh consists of the calory for heating the tray of 65 kwh, calory of heating $N_2$ of 12 kwh, heat loss of 122 kwh and others (electric power for driving vacuum pump in the substitution room, etc.) of 22 kwh.

STARTING MATERIAL

Content of carbon: from 89 to 97% by weight
Molecular weight: from 400 to 5000
Softening point: not lower than 150° C.

| Spinning | Conventional (centrifugal spinning - tow) | Present Invention (centrifugal spinning - mat) |
|---|---|---|
| Spinning machine | 3 units | 3 units |
| Loss in spinning | to 5% by weight | to 1% by weight*[1] |
| Filling machine | 3 units | not necessary |
| Traverser | 3 units | 1 unit |
| Diameter of unit fiber | to 25 micrometers | to 25 micrometers |
| Aerial weight | 0.44 kg/m$^2$ | 0.75 kg/m$^2$*[2] |
| Thickness of mat | to 50 mm | 50 mm*[3] |

| Cutting | Conventional | Present invention |
|---|---|---|
| Cutting | tows were treated | mat was treated |

Table 1 shows the production efficiency and the consumption of energy in Example 1 and Comparative Example 1 as follows:

TABLE 1

| Step | Item: Production efficiency ($kg/m^3 \cdot hour$) Present invention | Production efficiency ($kg/m^3 \cdot hour$) Conventional method | Consumption of energy (kwh) Present invention | Consumption of energy (kwh) Conventional method |
|---|---|---|---|---|
| Infusibilization | 1.32 | 1.01 | 136 | 189 |
| Calcination | 13.4 | 1.56 | 64 | 285 |

As has been seen in Table 1, the remarkable improvement of the production efficiency and the consumption of energy were effected both in infusibilization and in calcination according to the present invention. Namely, the production efficiency was raised by about 32% in the infusibilizing furnace and by about 759% in the calcining furnace, and on the other hand, the amount of energy consumption was reduced by about 28% in the infusibilizing furnace and by about 78% in the calcining furnace, the facts showing that the improvement is particularly remarkable in the calcining furnace.

What is claimed is:

1. A process for producing a carbon fiber mat, comprising the successive steps of:

(a) melt-spinning a fiber-forming pitch using a centrifugal spinning machine of the type having a horizontal axis of rotation, (b) stretching the thus melt-spun pitch fibers, (c) cutting the thus stretched fibers using at least one cutter installed on a stretching plate of said centrifugal spinning machine, (d) piling the thus cut fibers on a belt of a horizontal belt conveyer positioned below said spinning machine, (e) simultaneously (i) traversing said belt in a direction parallel to said axis of rotation and (ii) moving said belt in a direction orthogonal to said axis of rotation, thereby forming a pitch fiber mat upon said belt, and then (f) subjecting the thus piled pitch fiber mat to infusibilization in an air atmosphere containing $NO_2$ and calcination in an inert atmosphere to obtain said carbon fiber mat.

2. A process according to claim 1, wherein said fiber-forming pitch has a carbon content of from 89 to 97% by weight and an average molecular weight of from 400 to 5000.

3. A process according to claim 1, wherein said centrifugal spinning machine is a rotation nozzle type centrifugal spinning machine.

4. A process according to claim 3, wherein said spinning machine has a rotary bowl and wherein the diameter of said rotary bowl is from 100 to 500 mm.

5. A process according to claim 1, wherein said step (b) of stretching the melt-spun pitch fibers is practiced using a fluid stream having a velocity of from 80 to 120 m/sec.

6. A process according to claim 3, wherein the diameter of the nozzle holes of said centrifugal spinning machine is from 0.6 to 1.0 mm.

7. A process according to claim 1, wherein said melt spun fibers are piled after cutting thereof into a nearly constant thickness.

8. A process according to claim 1, wherein the aerial weight and the thickness of said carbon fiber mat are respectively, from 0.2 to 5 $kg/m^2$ and from 10 to 100 mm.

9. A process according to claim 1, wherein traversal of said conveyer belt is such that the surface width of said piled melt-spun fibers is not more than 3 m.

10. A process according to claim 1, wherein the conveyer belt is permeable to gases and wherein step (d) is practiced by applying suction along a side of said belt opposite to that side thereof upon which the fibers are piled.

11. A process according to claim 1, wherein step(f) is practiced in an infusibilizing furnace, and wherein atmospheric gas is passed in a direction orthogonal to the direction of orientation of said spun pitch fibers and circulates in said infusibilizing furnace.

12. An apparatus for continuously producing a carbon fiber mat, comprising:

(i) a centrifugal spinning machine rotatable about an axis and having a stretching plate and at least one cutter for cutting said pitch fibers on the stretching plate thereof, said spinning machine being positioned such that said rotational axis thereof is horizontal; and (ii) a horizontally disposed belt conveyer having a belt for collecting said cut fibers and to thereby form a mat thereof, said belt conveyer including means for simultaneously (a) causing said belt to traverse in a direction parallel to said rotational axis of said centrifugal spinning machine and (b) moving said belt in a direction orthogonal to said first-mentioned direction, (iii) an infusibilizing furnace;

(iv) first transfer conveyer means for transferring said pitch fiber mat from said belt conveyer to said infusibilizing furnace, (v) a vertical-type calcining furnace, and (vi) second transfer conveyer means for transferring said infusibilized mat from said infusibilizing furnace to said calcining furnace.

13. A process for producing a carbon fiber mat wherein the carbon fibers thereof are oriented in a longitudinal direction of the mat, said process comprising the sequential steps of:

(a) melt-spinning a fiber-forming carbon pitch using a centrifugal spinning machine having a horizontal axis of rotation which is orthogonal to said longitudinal direction to thereby form melt-spun fibers oriented in said longitudinal direction;

(b) stretching and cutting the thus melt-spun fibers;

(c) collecting the stretched and cut fibers upon a belt; and (d) forming a mat of said stretched and cut fibers by continuously horizontally moving the belt in said longitudinal direction during collection of the stretched and cut fibers thereon while simultaneously horizontally traversing said belt in a direction parallel to said axis of rotation of said melt-spinning machine, and thus in a direction orthogonal to said longitudinal direction, thereby forming a mat comprised of said stretched and cut fibers oriented in said longitudinal direction;

(e) subjecting said formed mat to infusibilization in an air atmosphere containing $NO_2$; and (f) calcining said infusibilized mat in an inert atmosphere to obtain said carbon fiber mat.

14. Apparatus for producing a carbon fiber mat wherein the carbon fibers thereof are oriented in a longitudinal direction of the mat, said apparatus comprising:

(a) a centrifugal spinning machine having a horizontal axis of rotation which is orthogonal to said longitudinal direction for forming melt-spun fibers from a fiber-forming carbon pitch and for orienting said melt-spun fibers in said longitudinal direction;

(b) means for stretching and cutting the thus melt-spun fibers;

(c) an endless belt for collecting the stretched and cut fibers; and (d) belt moving and traversing means for (i) continuously horizontally moving said belt in said longitudinal direction during collection of the stretched and cut fibers thereon while simultaneously (ii) reciprocally horizontally traversing said belt in a direction parallel to said axis of rotation of said melt-spinning machine, and thus in a direction orthogonal to said longitudinal direction, whereby a mat comprised of said stretched and cut fibers oriented in said longitudinal direction is formed.

15. Apparatus as in claim 14, further comprising (e) means for subjecting said formed mat to infusibilization in an air atmosphere containing $NO_2$ and (f) means for calcining said infusibilized mat in an inert atmosphere to obtain said carbon fiber mat.

16. Apparatus as in claim 14, wherein said belt moving and traversing means includes carriage means for mounting said belt to permit said horizontal movement thereof in said longitudinal direction and to permit said reciprocal horizontal traversing movements thereof in said parallel direction relative to said axis of rotation of said spinning machine.

17. Apparatus as in claim 16, wherein said carriage means includes driven rollers for moving said belt in said longitudinal direction, and motive means for causing said carriage means to reciprocally traverse in said direction parallel to said axis of rotation.

* * * * *